US005213469A

United States Patent [19]

Mitsch et al.

[11] Patent Number: 5,213,469

[45] Date of Patent: May 25, 1993

[54] SEWAGE PUMP WITH IMPROVED INLET CONSTRUCTION

[75] Inventors: Brian M. Mitsch, Perrysville; Ralph D. Austen, Jeromesville; Robert S. Jones, Mansfield, all of Ohio

[73] Assignee: General Signal Corporation, Stamford, Conn.

[21] Appl. No.: 819,027

[22] Filed: Jan. 10, 1992

[51] Int. Cl.[5] ..... F01D 25/24

[52] U.S. Cl. ..... 415/182.1; 415/203; 415/206

[58] Field of Search ..... 415/182.1, 204, 206, 415/121.2, 183, 121.1, 203

[56] References Cited

U.S. PATENT DOCUMENTS

| | | | |
|---|---|---|---|
| 1,225,122 | 5/1917 | Fleck | 415/206 |
| 1,649,161 | 11/1927 | Foster | 415/206 |
| 3,097,554 | 7/1963 | Rice et al. | 415/203 |
| 3,180,269 | 4/1965 | Wells | 415/206 |
| 3,824,028 | 7/1974 | Zenkner et al. | 415/206 |
| 3,973,866 | 8/1976 | Vaughan | 415/121.1 |
| 4,392,779 | 7/1983 | Bloemers et al. | 415/182.1 |
| 4,842,479 | 6/1989 | Dorsch | 415/206 |

FOREIGN PATENT DOCUMENTS

| | | | |
|---|---|---|---|
| 1046502 | 12/1958 | Fed. Rep. of Germany | 415/206 |
| 2204671 | 8/1972 | Fed. Rep. of Germany | 415/182.1 |
| 1377185 | 9/1964 | France | 415/206 |
| 15246 | 3/1905 | Sweden | 415/206 |

*Primary Examiner*—John T. Kwon

*Attorney, Agent, or Firm*—Milton E. Kleinman; Ray E. Smiley; Robert S. Smith

[57] ABSTRACT

A pump which includes a housing and a shaft disposed within the housing having an axis. The apparatus also includes apparatus for mounting the shaft within the housing for rotational movement thereof and an impeller having a geometric center carried on the shaft. A fluid inlet in the housing is disposed with a first opening disposed in eccentric relationship to the geometric center of the impeller. In some forms of the invention the opening is generally shaped like a dog bone with the two largest parts thereof spaced apart from the geometric center of the impeller.

20 Claims, 3 Drawing Sheets

SEWAGE PUMP WITH IMPROVED INLET CONSTRUCTION

BACKGROUND OF THE INVENTION

1. Field of the Invention

This invention relates to pumps and particularly to pumps adapted for pumping sewage and other liquids in which solid matter and stringy material is disposed.

2. Description of Related Art

Certain well known formulas determine the inlet (suction) opening area of sewage pumps. If the inlet opening is too large, the pump uses a larger amount of energy than is desired due to the amount of extra fluid pumped. If the inlet opening is too small, it restricts the amount of fluid that can enter the pump and thus decreases performance. To overcome the pressure drop encountered due to the smaller opening, a larger amount of energy than with a properly sized opening is required to pull the fluid through the opening.

In known prior art pump designs the inlet opening is round and the formula dictates an opening diameter which is larger than the size of solids that the pump can safely pass without clogging. To overcome the problem of attempted passage of solids which are too large in diameter, pump manufacturers commonly place screens in the inlet opening to reduce the size which may pass through the pump. Unfortunately, the material which the pump is attempting to pass often contains so-called stringy material, that is long strands of material of some sort, and this stringy material gets caught on the screen that is often disposed over the pump inlet. This ultimately decreases the opening area to a value that is too small to allow the pump to operate properly.

The prior art pumps that have a screen disposed over the inlet of the pump have not been wholly satisfactory because conventional screens will clog very easily.

It is an object of the invention to limit the passage of large solid material from entering the pump while allowing the passage of relatively stringy material.

Another object of the invention is to provide proper suction area for the pump while controlling particle size that is delivered to the pump.

It is an object of the invention to provide apparatus that may even be retrofitted on some existing pumps.

It is an object of the invention to provide apparatus which is inexpensive to manufacture as well as requires a minimum of labor to install.

Still another object of the invention is to provide a form of the invention that will limit the maximum size to the solid that will enter the pump.

Yet another object of the invention is to provide apparatus that will allow simultaneous passage of two discrete generally spheroidal solids simultaneously.

A further object of the invention is to provide apparatus that will also have an opening area that has an optimized area.

SUMMARY OF THE INVENTION

It has now been found that these and other objects of the invention may be attained in a pump which includes a housing and a shaft disposed within the housing having an axis. The apparatus also includes means for mounting the shaft within the housing for rotational movement thereof and an impeller having a geometric center carried on the shaft.

In some forms of the invention the fluid inlet further includes a second opening in the housing disposed in eccentric relationship to the geometric center of the impeller and in some cases the fluid inlet includes an elongated section connecting the first and second openings. The first and second openings may be generally oval shaped. In some forms of the invention the elongated section has generally parallel spaced rectilinear sides and the first and second openings each have major and minor axes and the major axes are disposed in substantially perpendicular relationship to the generally parallel sides of the elongated section.

The minor axes may be disposed in aligned end abutting relationship and the major axes may be disposed in aligned parallel relationship. The centers of curvature of each of the axial extremities of the first and second openings and the elongated section may have a radius of curvature having a center that is no closer than the midpoint of the opening between the axial extremities. In other cases the centers of curvature of each of the axial extremities of the first and second openings and the elongated section have a radius of curvature that has a center that is further away than the midpoint of the opening between the axial extremities.

Some forms of the invention include a metal plate in which the inlet is disposed.

BRIEF DESCRIPTION OF THE DRAWING

The invention will be better understood by reference to the accompanying drawing in which.

DESCRIPTION OF THE PREFERRED EMBODIMENTS

Figure 1:
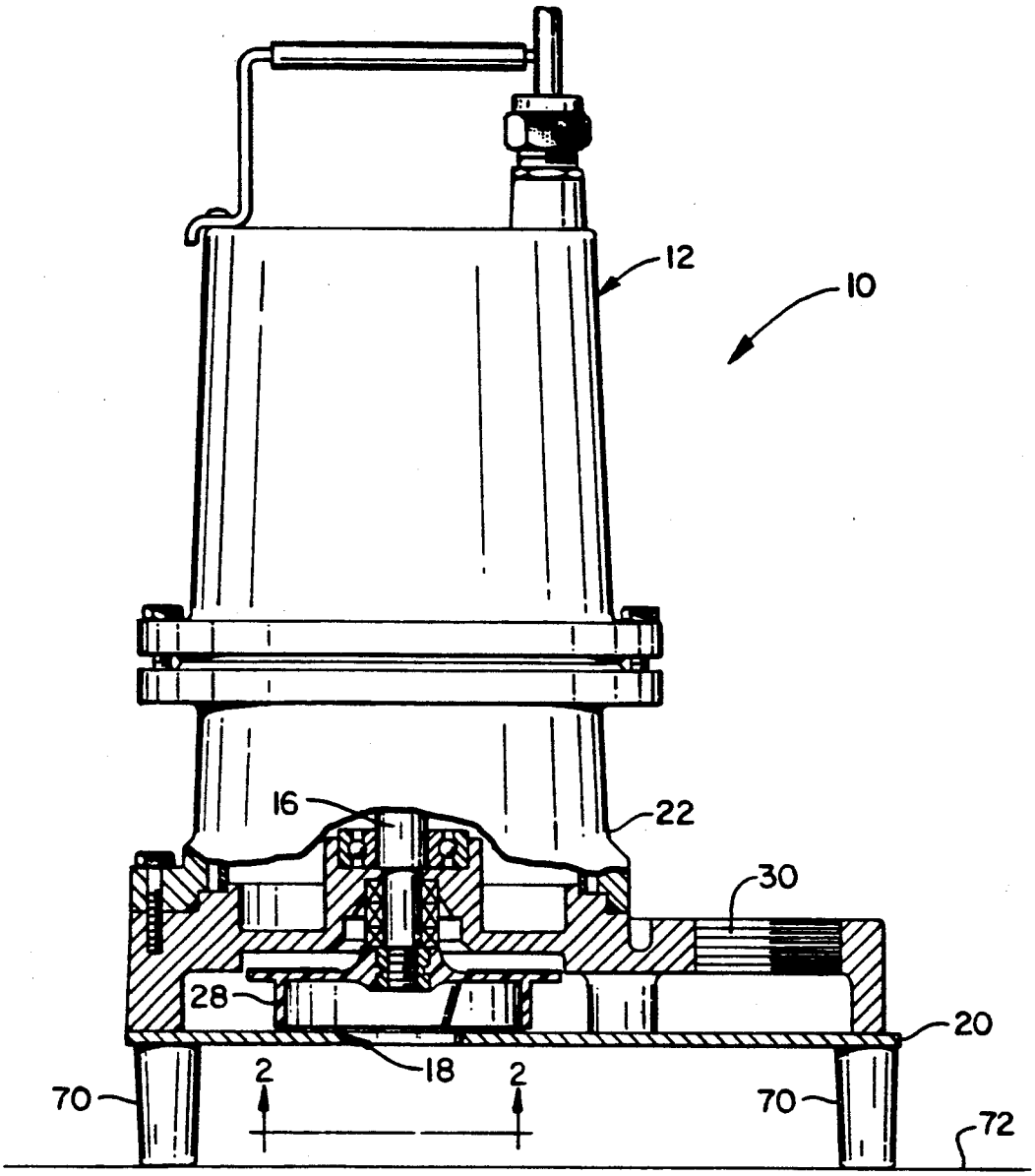
FIG. 1 is an elevational view in partial section of a pump in accordance with one form of the invention.

Referring now to FIGS. 1–4 there is shown an exemplary solid handling sewage pump 10 that includes a housing 12 in which is a motor (not shown). The motor 10 includes a shaft 16 which extends axially downward (as viewed) to an inlet 18 provided at one end of the housing 12. The inlet 18 is formed in an inlet or suction plate 20 that is secured to a section 22 of the housing 12 by screws (not shown) or the like.

In the preferred embodiment the inlet 18 is an opening that includes first and second spaced oval portions 18A and 18B that are joined by a bridge 18C. In the preferred embodiment the oval portions each have a rounded symmetrical shape that is longer than broad. One of the two longer sides of each oval portion 18A and 18B joins with a bridge 18C that has parallel opposed sides. The oval portions 18A and 18B have respective major and minor axes 118, 218. The major axes 118, 118 are disposed in spaced parallel relationship and the minor axes 218 are disposed in aligned relationship. The oval portions are sized to allow simultaneous passage of two solids each of a given diameter X into inlet 18 while preventing passage of any solid with a diameter greater than X.

In other words the minor axes of the oval portions 18A and 18B are disposed in end abutting relation and are parallel to the linear sides of the bridge 18C. More specifically, the minor axes of the oval portions 18A and 18B are disposed equidistant from the parallel sides of the bridge 18C. The shape of the inlet 18 in the preferred embodiment is somewhat like the shape of a "dog bone" and having an area which is idealy sized for the desired pump characteristics.

The lowermost (as viewed) axial extremity of the shaft 16 has mounted thereon an impeller 28. The impeller 28 has a plurality curved radially extending vanes 32 which are customary formed integrally therewith. Depending on the application the precise geometry will differ. For example the suction plate 20 may be spaced axially with respect to the impeller. More particularly, usually the spacing will be approximately the same as the minor "diameter" md of the oval portions 18A and 18B so that solid matter that passes through the inlet 18 will freely pass into the engagement with the impeller 28. Ordinarily, no parts of the opening 18 will overlap any part of the vanes 32. This will ordinarily be true for all configurations of the plate 20.

The apparatus also includes legs 70 to support the apparatus in a reservoir 72. The pumped liquid passes out the outlet 30. The discrete suction plate 20 shown in the drawings permits the use of a casting technique for the housing 12 that does not require a core. In other embodiments of the invention the housing may be manufactured by a casting technique that does utilize a core. In those embodiments the shape of the inlet 18 may be substantially the same. In some of these embodiments the inlet may be necked down like a cookie cutter.

Figure 2:
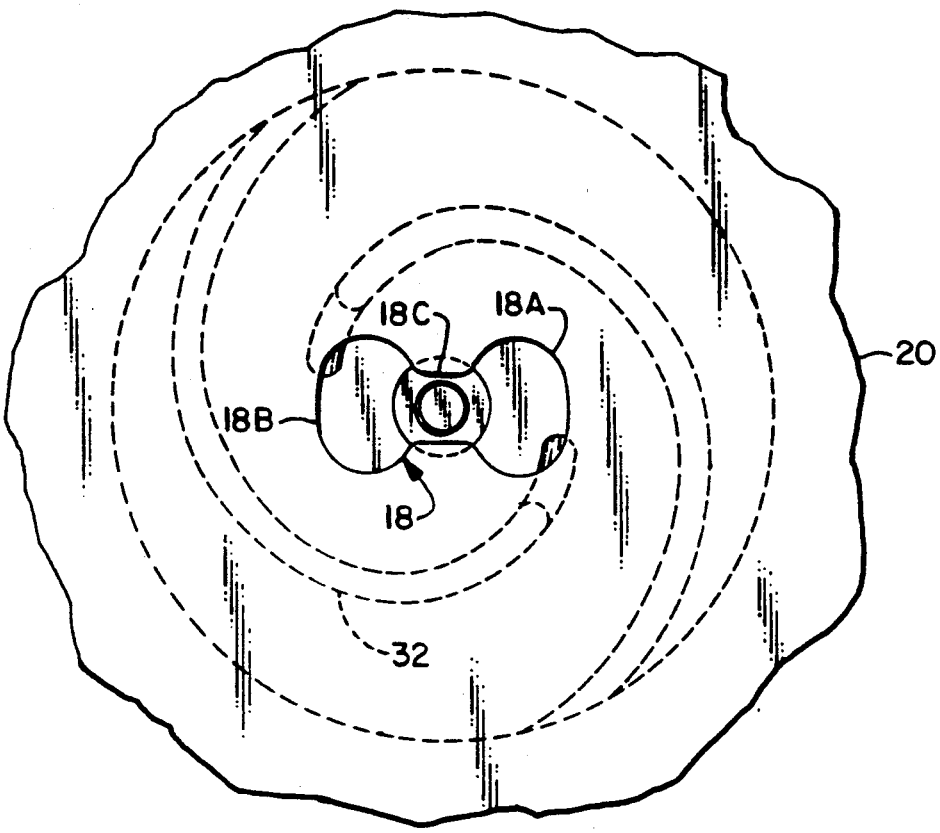
FIG. 2 is a bottom view of a portion of the inlet plate in accordance with the preferred form of the invention.
Figure 3:
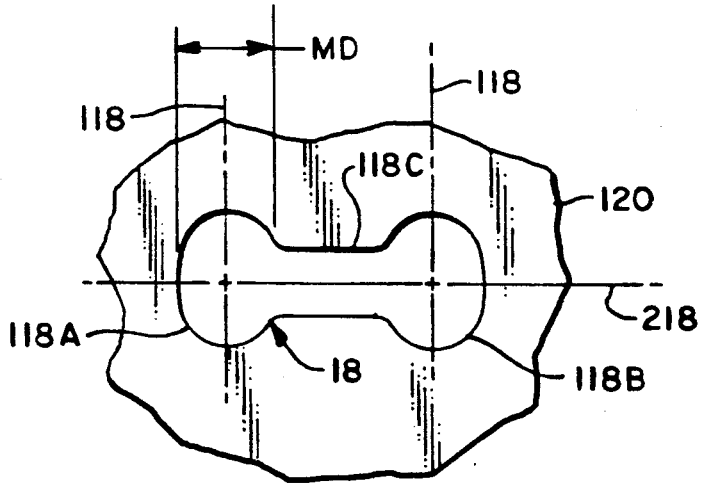
FIG. 3 is a bottom view to a larger scale of another form of the inlet plate in accordance with another form of the invention.

Referring now to FIG. 3 there is another form of the invention which is similar to that shown in FIG. 2 except the inlet 118 has spacing between the oval shaped openings 118A and 118B that is greater than the inlet 18. In other words the bridge 118C is longer than the bridge 18C shown in FIG. 2. More specifically, the center of curvature of the axial extremities of the inlet 118 is substantially on the vertical and horizontal centerlines thereof. In the embodiment of FIG. 2 the center of curvature of the right axial extremity is spaced to the left of the axial midpoint of the opening 18. Similarly, the center of curvature of the left axial extremity is spaced to the right of the axial midpoint of the opening 18. In various forms of the invention the inlet may be epoxy coated.

Figure 4:
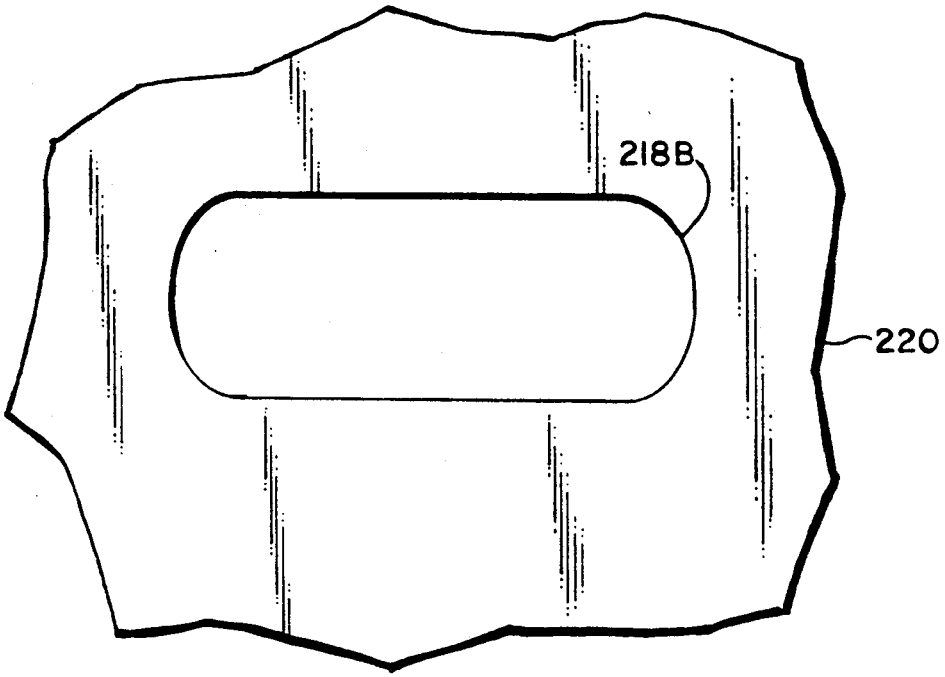
FIG. 4 is a bottom view of still another form of the inlet plate in accordance with the invention.

Referring now to FIG. 4 there is shown still another form of the apparatus in accordance with the invention. A plate 220 has a oval opening 218B. The term "oval" as used herein refers to a rectangle having rounded corners. The opening 218B is dimensioned and configured so that two spheroidal bodies of material each having a diameter X inches will pass through the opening 218B. It will follow that the opening will be approximately X inches broad and 2X long or longer to conform to the desired area of the opening. This embodiment of the invention is particularly advantageous because there is a minimum of irregular edges that will catch on the material be pumped. In this embodiment of the invention the plate 222A may also be epoxy coated to minimize catching of material on the opening 218B The invention has been described with reference to its illustrated preferred embodiment. Persons skilled in the art of such devices may upon exposure to the teachings herein, conceive other variations. Such variations are deemed to be encompassed by the disclosure, the invention being delimited only by the appended claims.

Having thus described our invention we claim:

1. A pump which includes:

a housing;

a shaft disposed within said housing having an axis;

means for mounting said shaft within said housing for rotational movement thereof;

an impeller carried on said shaft, said impeller having a geometric center;

a fluid inlet in said housing disposed with a first portion disposed in eccentric relationship to the geometric center of said impeller, said fluid inlet further including a second portion in said housing disposed in eccentric relationship to the geometric center of said impeller, said fluid inlet including an elongated section connecting said first and second openings.

2. The apparatus as described in claim 1 wherein:

said first and second openings are generally oval shaped.

3. The apparatus as described in claim 2 wherein:

said housing includes a metal plate in which said fluid inlet is disposed.

4. The apparatus as described in claim 2 wherein:

said elongated section has generally parallel spaced rectilinear sides.

5. The apparatus as described in claim 4 wherein:

said first and second openings each have major and minor axes and said major axes are disposed in substantially perpendicular relationship to said generally parallel sides of said elongated section.

6. The apparatus as described in claim 5 further including:

said housing includes a metal plate in which said fluid inlet is disposed.

7. The apparatus as described in claim 5 wherein:

said minor axes are disposed in aligned relationship.

8. The apparatus as described in claim 7 wherein:

said housing includes a metal plate in which said fluid inlet is disposed.

9. The apparatus as described in claim 1 wherein:

said housing includes a metal plate in which said fluid inlet is disposed.

10. The apparatus as described in claim 9 wherein:

said plate is epoxy coated.

11. The apparatus as described in claim 9 further including:

said housing includes a metal plate in which said fluid inlet is disposed.

12. The apparatus as described in claim 1 wherein:

one of said openings is oval.

13. The apparatus as described in claim 12 wherein:

each oval opening is approximately twice as long as it is wide.

14. The apparatus as described in claim 12 wherein:

said housing includes a metal plate in which said fluid inlet is disposed.

15. The apparatus as described in claim 1 wherein:

both of said openings are oval.

16. The apparatus as described in claim 15 wherein:

each oval opening is approximately twice as long as it is wide.

17. The apparatus as described in claim 16 wherein:

each of oval shaped openings has a minor axes and said minor axes are disposed in aligned relationship.

18. The apparatus as described in claim 17 wherein:

said minor axes are disposed in end abutting relationship.

19. The apparatus as described in claim 17 wherein:

each of said openings includes arc shaped axial extremities and an elongated section between said axial extremities.

20. The apparatus as described in claim 1 wherein:

said housing includes a metal plate in which said fluid inlet is disposed.

* * * * *